United States Patent [19]

Nomura et al.

[11] Patent Number: 4,663,200

[45] Date of Patent: May 5, 1987

[54] SOFTENING AGENT AND METHOD OF PRODUCING ACRYLIC FIBER HAVING ANIMAL HAIR-LIKE TOUCH BY TREATMENT WITH SAID AGENT

[75] Inventors: Katsuaki Nomura; Hideyuki Tsurumi, both of Okayama, Japan

[73] Assignee: Japan Exlan Company Limited, Osaka, Japan

[21] Appl. No.: 791,159

[22] Filed: Oct. 22, 1985

[30] Foreign Application Priority Data

Aug. 21, 1985 [JP] Japan ..... 60-184519
Aug. 26, 1985 [JP] Japan ..... 60-188194

[51] Int. Cl.[4] ..... B05D 3/02

[52] U.S. Cl. ..... 427/387; 106/287.11; 427/175; 427/180; 427/389.9; 524/115; 524/121; 524/123; 524/127

[58] Field of Search ..... 427/180, 175, 387, 389.9; 106/287.11; 524/115, 121, 123, 127

[56] References Cited

U.S. PATENT DOCUMENTS 4,108,781 8/1978 Marshall et al. ..... 427/175
4,219,607 8/1980 Cammack, II et al. ..... 524/127

*Primary Examiner*—Melvyn I. Marquis
*Attorney, Agent, or Firm*—Wenderoth, Lind & Ponack

[57] ABSTRACT

The present invention provides a method of producing a softening agent in which a silicone resin containing particular functional groups, a particular emulsifier and a particular antistatic agent are dispersed stably in an aqueous medium in a particular ratio, and which can give durable slippery touch, softness and processability at the same time to fibers after treatment. The invention also provides an industrially advantageous method of producing acrylic fibers which have animal hair-like touch and processability by one-step treatment, by fixing said softening agent to the acrylic fibers.

12 Claims, 2 Drawing Figures

SOFTENING AGENT AND METHOD OF PRODUCING ACRYLIC FIBER HAVING ANIMAL HAIR-LIKE TOUCH BY TREATMENT WITH SAID AGENT

BACKGROUND OF THE INVENTION (a) Field of the Invention

The present invention relates to a softening agent composed of a particular silicone resin, emulsifier and antistatic agent, and to an industrial method of producing an acrylic fiber having animal hair-like touch by treatment with said softening agent.

(b) Description of the Prior Art

It is well known that knit fabrics produced from animal hair such as wool, cashmere, angora rabbit hair, etc. have excellent touch due to their particular slippery feel. In recent years, active attempts have been made to give such particular animal hair-like touch to synthetic fibers such as acrylic fibers.

For example, in Japanese Patent Publication No. 26436/69, a mixed treating agent of a slicone resin and an epoxy resin was disclosed as a treating agent for acrylic fiber products.

However, the touch of the final product becomes coarse by the stiffness due to the adhesion between fibers, and the slippery touch given by the silicon resin is hindered by the epoxy resin. Therefore the commodity value of the final product is materially reduced. On the other hand, the Applicant proposed in his Japanese Patent Publication No. 2556/76, method in which a particular silicone resin and an emulsifier selected from the group of POE (n') alkylphenyl phosphates are mixed under stirring with water to produce a weakly acid emulsion; the emulsion is applied to swollen gel acrylic filaments obtained by wet spinning; the filaments are dried immediately; and then a spinning oil is given to the filaments. By employing this method although it is possible to give slippery touch and softness resembling those of animal fiber products, and anti-shrinking properties to acrylic fibers or their products, this method necessiates two-step, two-bath treatment of the silicone treatment and oiling treatment, and therefore this method is not necessarily a desirable technique for industrial production. Thus, further improvements have been demanded.

Under such circumstances, we, the inventors, conducted research in various ways to provide a method of producing an acrylic fiber which will satisfy the touch and processability requirements at the same time by one-step treatment by the coexistence of an antistatic agent in a silicone emulsion. But when the antistatic agent was added to the silicone emulsion, the stability of the emulsion was remarkably impaired, and it was impossible to apply the treating agent uniformly to the fibers. Therefore, because of yarn breakage and winding around rollers caused in the succeeding steps, continuous operation was greatly hindered. Also, when a stable emulsion was obtained, it was impossible to produce fibers having satisfactory touch and processability. Thus, it was found that there was great difficulty in satisfying the touch and spinnability requirements at the same time.

SUMMARY OF THE INVENTION

Hereupon we conducted intensive research into treating agents capable of giving durable slippery touch and processability at the same time by one-step treatment, which was thought to be impossible. As a result, we found that by selecting a particular silicone resin, emulsifier and antistatic agent and by making the three coexist in a particular ratio, it is possible to obtain the desired softening agent, and that by applying said softening agent to acrylic fibers, it is possible to produce acrylic fibers which satisfy both touch and processability, and yet without causing problems such as yarn breakage and winding around rollers. The present invention is based on this finding.

Therefore, an object of the present invention is to provide a softening agent which can give durable slippery touch and processability such as spinnability by one-step treatment, and an industrial method of producing acrylic fibers having animal hair-like excellent touch by applying the treating agent to the acrylic fibers.

Another object of the present invention is to provide a softening agent having excellent bath stability and good operability, which can be applied uniformly to fibers to be treated and has excellent continuous operability without causing troubles such as yarn breakage or winding around rollers in the succeeding processing steps such as raw fiber production and spinning, and to provide an industrially advantageous method of producing acrylic fibers having excellent animal hair-like touch by treating the fibers with said treating agent.

A further object of the invention is to provide a softening agent which can be applied to fibers in any desired steps of raw fiber production, for example immediately after filament spinning or after heat treatment, etc. and which can be widely applied to fibers of various brands.

Other objects of the invention will become apparent from the following explanation.

Such objects of the present invention can be attained effectively by a softening agent in which (A) an organopolysiloxane containing primary and secondary amino groups represented by the general formula: $-RNHR'NH_2$ wherein each of R and R' is an alkylene group of 1 to 6 carbon atoms, (B) a partial phosphoric acid ester (the acid value of which is from 14 to 60) of POE (l) alkylphenyl ether or POE (m) sec-alkyl ether (wherein l and m are the degree of polymerization of polyoxyethylene), and (C) a neutralized salt of complete or partial phosphoric acid ester of POE (n) alkyl ether (wherein n is the degree of polymerization of polyoxyethylene, and the degree of phosphorization of said salt is more than 0.5)

are stably dispersed in an aqueous medium in the ratio of 1 weight part of (A), 0.1 to 0.5 weight part of (B) and 0.1 to 4.0 weight parts of (C), and by applying said treating agent to acrylic fibers and thereafter heat-treating the fibers. Throughout the specification "POE" represents a polyoxyethylene chain of $-(C_2H_4O)-$ units.

DETAILED DESCRIPTION OF THE INVENTION

Figure 1:
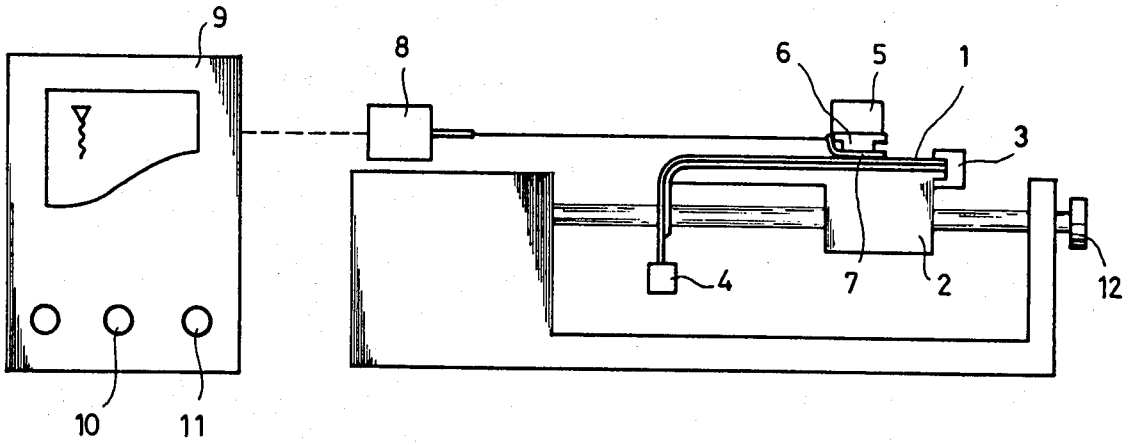
Figure 1:
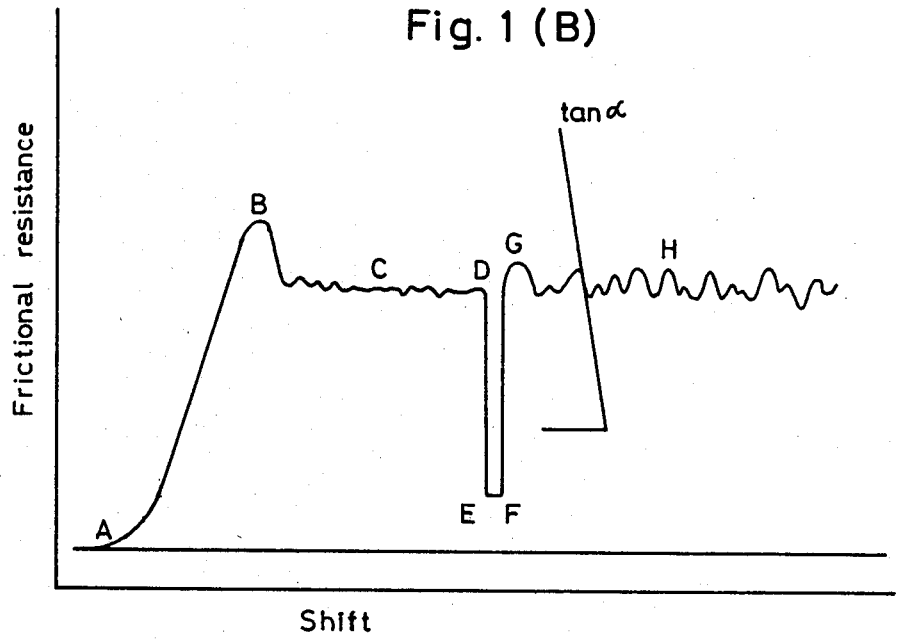

The invention will be explained in more detail as follows by referring partly to the accompanying drawings wherein FIG. 1(A) is an illustration of a friction tester of a cloth used for the measurement of slippery touch, and FIG. 1(B) is a line in rectangular coordinates showing an example of the relation between the frictional resistance recorded by the tester and the shift of the cloth.

The organopolysiloxane (A) according to the present invention is a silicone resin containing as essential functional groups, primary and secondary amino groups represented by the general formula: $-RNHR'NH_2$ wherein each of R and R' is an alkylene group of 1 to 6 carbon atoms. Only by empolying a silicone resin containing such particular functional groups, it is possible to produce a stable emulsion and to give durable slippery touch and processability to fibers to be treated. By employing a silicone resin whose content of such amino groups is 0.1 to 2.0 m mol/g, preferably 0.2 to 1.0 m mol/g, the objects of the present invention can be attained more effectively. A silicone resin having a molecular weight less than 100,000 is recommended from the viewpoint of viscosity, operability, etc.

The partial phosphoric acid ester (B) of POE (l) alkylphenyl ether or POE (m) sec-alkyl ether, wherein l and m are the degree of polymerization of polyoxyethylene, employed as an essential emulsifier in the present invention, is such that l is 5 to 20, preferably 6 to 10, m is 5 to 20, preferably 7 to 10, the number of carbon atoms of the alkyl group is 8 to 12, the number of carbon atoms of the sec-alkyl group is 9 to 17, and the acid value is 14 to 60, preferably 25 to 45. By employing such a partial phosphoric acid ester in combination with the above-mentioned particular silicone resin (A), it is possible to improve the touch, spinnability and bath stability to a further extent. As examples of such emulsifier, the following can be mentioned: partial phosphoric acid esters of POE (7) octylphenyl ether, POE (8) octylphenyl ether, POE (9) octylphenyl ether, POE (7) nonylphenyl ether, POE (8) nonylphenyl ether, POE (9) nonylphenyl ether, POE (10) dodecylphenyl ether, TERGITOL 13-s, 15-s, 45-s, etc. produced by Union Carbide Corporation.

The neutralized salt of complete or partial phosphoric acid ester of POE (n) alkyl ether which is made to coexist in the treating agent as an essential antistatic agent in the present invention is such that n is 3 to 30, preferably 5 to 20, the number of carbon atoms of the alkyl group is 8 to 18, preferably 12 to 16, the degree of phosphorization (the molar ratio of the neutralized salt of the phosphoric acid ester to the total amount of said antistatic agent) is more than 0.5, preferably 0.6 to 0.9, and the acid value is less than 14. By employing such a neutralized salt (C) of complete or partial phosphoric acid ester of POE (n) alkyl ether, the objects of the present invention can be attained more effectively. As examples of such antistatic agents, it is possible to mention neutralized salts of complete or partial phosphoric acid ester of POE (5) octyl ether, POE (5) dodecyl ether, POE (10) cetyl ether, POE (15) cethyl ether, POE (20) stearyl ether, etc. The kind of neutralized salt of such phosphoric acid ester is not limited, but it is desirable to employ strong basic salts such as salts of potassium, sodium, etc.

In order to attain the objects of the invention, it is important, in addition to the selection of the above-mentioned components A, B, and C, to suitably select the mixing ratio of the components. It is necessary to prepare the treating agent so that, for one weight part of the silicone resin (A), the emulsifier (B) should be 0.1 to 0.5 part, preferably 0.2 to 0.4 part, and the antistatic agent (C) should be 0.1 to 4.0 parts, desirably 0.2 to 2.0 parts, and more desirably 0.3 to 1.0 part. When the mixing ratio is out of the range recommended in the present invention, it is impossible to produce a stable emulsion and also to give durable slippery touch and good processability to fibers after treatment. It is particularly mentioned that when the silicone resin (A) and the emulsifier (B) satisfy the following relationship, the objects of the present invention can be more effectively attained:

$$38N \leqq X \leqq 105N$$

wherein N is the content (m mol/g) of the amino groups in the silicone resin and X is the acid value of the emulsifier (B).

The method of preparing the softening agent is not limited as far as the components A, B, and C are made to exist in the above-mentioned ratio. However, the softening agent can be more advantageously prepared, for example, by dissolving the emulsifier (B) in an aqueous medium under stirring, and thereafter adding a predetermined quantity of the silicone resin (A) and then that of the antistatic agent. As the aqueous medium, it is desirable to use water alone for industrial convenience. But as far as a desired emulsion can be produced, it is possible to use a mixed solvent of water and a water-miscible organic solvent, for example, alcohols, ketones, etc. In order to obtain a suitable viscosity and emulsifying properties for the convenience of handling, it is desirable to prepare the treating agent at about 30° to 70° C., preferably 35° to 60° C. so that the concentration of the total amount of the components A, B, and C should be less than 50%, preferably less than 30%, based on the total amount of the treating agent.

The kind of fibers to be treated, to which the softening agent of the present invention is applied, is not limited. However, if the softening agent is applied to acid-group-containing fibers such as basic-dye dyeable acrylic fibers, Polyester fibers, etc. and especially to the acrylic fibers, the amino groups contained in the silicone resin will form strong ionic bonds with the acid groups present in the fibers to be treated, thereby remarkably improving the durability of the touch of the fibers.

Such acrylic fibers are those composed of polyacrylonitrile alone or a copolymer of acrylonitrile in an amount of more than 60% by weight, preferably more than 80% by weight, with another vinyl monomer, and obtained in the usual way by wet spinning, dry spinning, or dry-wet spinning. Even if such fibers are those in the course of production, as far as they have passed through the steps of coagulation and water-washing, the fibers can be suitably employed. Especially, when acrylic fibers before dry heat treatment or before drying treatment are treated with the softening agent, it is possible, by the succeeding dry heat treatment step or drying treatment step, to carry out the fixation and heat treatment of the silicone resin at the same time.

As the method of heat treatment for acrylic fibers to which the softening agent has been applied, any method can be employed as far as the silicone resin can be fixed to the fiber surface. However, from the viewpoint of industrial practice, it is generally desirable to employ a temperature between 60° and 150° C., preferably between 80° and 130° C., in a wet heat or dry heat atmosphere. As mentioned above, that such heat treatment serves also as the succeeding drying step.

The amount of the softening agent according to the present invention to be applied to fibers should be suitably determined in consideration of the desired touch, etc. However, it is desirable to determine the amount of the silicone resin in the softening agent generally in the range of from 0.05 to 2.0%, preferably in the range of from 0.1 to 0.6%, based on the dry weight of the fibers to be treated. When the amount is less than the lower limit of the range, it is impossible to give the fibers sufficient slippery touch. When the amount exceeds the upper limit of the range, troubles will be caused such as adhesion between single fibers, winding of fibers around the taker-in roller of the card, winding of fibers around the top roller of the gill, etc. in the spinning step.

It is an effect wortyy of spcial mention of the present invention that, by applying the softening agent of the invention in which the particular silicone resin, emulsifier and antistatic agent are dispersed stably in an aqueous medium in the particular ratio, it is possible to give fibers durable slippery touch and processability such as spinnability, with only a small amount of application and by one-step treatment.

It is also a characteristic advantage of the present invention that the softening agent according to the present invention which has excellent bath stability can be applied efficiently and uniformly to fibers to be treated, and can improve the touch of the fibers remarkably, without causing troubles such as yarn breakage, winding of fibers around rollers, etc. in the succeeding steps of raw fiber preparation and spinning.

The advent of the present invention relating to the softening agent which can satisfy the requirements of durable touch and processability at the same time by one-bath treatment, contributes greatly to the technical field of giving animal hair-like slippery touch to fibers while retaining the advantages of the fibers to be treated. Also, it contributes greatly to the technical field of industrially producing acrylic fibers having animal hair-like touch while retaining the advantages of the acrylic fibers to be treated.

For a better understanding of the present invention, representative examples of the invention will be described in the following. However, it is to be understood that the gist of the invention is nt limited by the description of these examples. Unless otherwise indicated, parts and percentages in the examples are by weight.

The ratio of stress lowering on dynamic friction (tan $\alpha$), slipperiness after boiling and spinnability described in the examples are measured by the following methods:

(1) Ratio of stress lowering on dynamic friction (tan $\alpha$)

The ratio of stress lowering on dynamic friction (tan $\alpha$) is obtaind by enlarged measurement of a dynamic frictional force between sample cloths by means of the cloth friction tester shown in FIG. 1(A). A more detailed explanation is given by referring also to FIG. 1(B). In a regulated wet atmosphere of 65% RH at 22° C., a sample cloth 1 is placed on a sample table 2. One end of the clotch is fixed by a sample press 3, and a weight 4 (30 g) is made to act on the other end so as to keep the sample in a tensional state. On this sample is placed a slider 6 having an effective contact surface of 3 $cm^2$ (2 cm × 1.5 cm) on which a compression weight 5 (450 g) is made to act. On the lower surface of the slider, a sample piece 7 is fixed. The sample table 2 is made to move at a constant speed of 12 mm/min. The frictional force generated between the cloths is detected by a resistance wire strain gauge 8 connected to the slider 6, and the frictional force is recorded by a recorder 9. During measurement, when the dynamic force shows a constant state, the recorder is set at the zero point. As shown at points F and G, the detection sensitivity is then enlarged 5 to 10 times to measure slight changes of the frictional force on an enlarged scale. The ratio of stress lowering (tan $\alpha$) on dynamic friction means, in the enlarged measurement diagram, the gradient at the stress lowering part at which a slip takes place between the sample cloths. The ratio of stress lowering can be expressed as a stress lowering ratio for one mm shift of the sample cloth. For a group of 20 samples, measurement is repeated 5 times for each sample. Thus, tan $\alpha$ is the average value of 100 tan $\alpha_i$. When tan $\alpha$ is less than 25 g/mm, good slippery touch like animal hair is felt.

(2) Slipperiness after boiling

Raw cut fibers are boiled in a free state for 60 minutes under the following condition, and after dehydration and drying, the slipperiness is evaluated by sensory tests.

Boiling condition:

Acetic acid: 4.0% o.w.f.

Sodium acetate: 0.5% o.w.f.

Bath ratio: 1:50

Evaluation of slipperiness after boiling by sensory tests

O: good

Δ: fairly good

×: bad (3) Spinnability

On spinning sample raw cut fibers into a yarn by the usual worsted spinning process, the operabilities on the whole, including card passing properties, winding of fibers around the roller at the gill, winding of fibers around the roller at the fine spinning frame, yarn breakage, etc. were evaluated. In the general evaluation except specially mentioned items, the mark O means good, Δ fair good, and × bad.

EXAMPLE 1

After three parts of POE (9) nonylphenyl ether partial phosphoric acid ester (emulsifier $b_1$) having an acid value of 33 was dissolved in 80 parts of water at 30° C., 11 parts of silicone resin ($a_1$) was added. Then 6 parts of potassium salt of partial phosphoric acid ester of POE (15) cetyl ether (antistatic agent $c_1$) having an acid value of 8 was added and mixed to produce treating agent (1).

As described in Table 1, in the same way as above, 7 additional kinds of treating agents (2 to 8) were produced, except that the kinds of emulsifiers and antistatic agents were changed.

The bath stability of these treating agents was evaluated. The results are shown in Table 1.

TABLE 1

| | Treating agent | | | |
|---|---|---|---|---|
| No. | Silicone resin (1) | Emulsifier (2) | Antistatic agent (3) | Bath stability (4) |
| 1 | $a_1$ | $b_1$ | $c_1$ | O |
| 2 | $a_1$ | $b_1$ | $c_2$ | X |
| 3 | $a_1$ | $b_1$ | $c_3$ | O |
| 4 | $a_1$ | $b_1$ | $c_4$ | O |
| 5 | $a_1$ | $b_2$ | $c_1$ | X |
| 6 | $a_1$ | $b_3$ | $c_1$ | X |
| 7 | $a_1$ | $b_4$ | $c_1$ | X |

TABLE 1-continued

| Treating agent | | | | |
|---|---|---|---|---|
| No. | Silicone resin (1) | Emulsifier (2) | Antistatic agent (3) | Bath stability (4) |
| 8 | $a_1$ | $b_5$ | $c_1$ | X |

Note:
(1) Silicone resin $a_1$:
functional group $-(CH_2)_3-\overset{\overset{H}{|}}{N}-(CH_2)_3-NH_2$
viscosity at 25° C. 4000 cs
content of amine 0.5 m mol/g
(2) Emulsifier $b_2$: same as $b_1$ except that the acid value is 2.
Emulsifier $b_3$: same as $b_1$ except that the acid value is 7.
Emulsifier $b_4$: same as $b_1$ except that the acid value is 10.
Emulsifier $b_5$: same as $b_1$ except that the acid value is 80.
(3) Antistatic agent
$c_2$: triethanol amine salt of partial phosphoric acid ester of POE (15) cetyl ether (degree of phosphorization: 0.7; acid value: 50)
$c_3$: potassium salt of cetyl phosphate (acid value: 2)
$c_4$: dimethylstearyl betaine
(4) Bath stability:
O good
Δ fairly good
X bad From the above Table, it is understood that softening agents having good bath stability can be produced only by the combination of three components: a silicone resin, an emulsifier, and an antistatic agent, which satisfy the present invention.

EXAMPLE 2

Four kinds of treating agents (No. 9 to No. 12) were produced by changing the mixing ratio of the components of No. 1 of Example 1 to the ratios described in Table 2. The results of evaluation of the bath stability are shown in Table 2.

TABLE 2

| Treating agent | | | | |
|---|---|---|---|---|
| No. | Silicone resin | Emulsifier | Antistatic agent | Bath stability |
| 1 | 11 | 3 | 6 | O |
| 9 | 13 | 1 | 6 | X |
| 10 | 9 | 5 | 6 | O |
| 11 | 16.5 | 2 | 1.5 | Δ |
| 12 | 3.5 | 1.5 | 14.5 | O |

EXAMPLE 3

By dissolving a copolymer (limiting viscosity [η] in dimethylformamide at 30° C. = 1.4) produced by copolymerizing 90% acrylonitrile, 9.8% methyl acrylate and 0.2% sodium methacryl sulfonate in a 50% sodium thiocyanate aqueous solution, a spinning solution of 12% polymer concentration was produced. The solution was spun into a 15% sodium thiocyanate aqueous solution. The resulting filaments were washed with water, stretched, and heat-treated in the usual way to produce a fiber tow.

Then, after immersing the fiber tow into the treating agent of Example 1 No. 1 diluted to a silicone resin concentration of 0.5%, the tow was squeezed so that the amount of the treating agent taken up by the tow became 70%, based on the dry weight of the fibers. The fiber tow was then dried in a hot air current at 125° C. for 15 minutes, and thereafter cut into unequal lengths in the range of 76 to 130 mm to produce Sample Fiber (I) having a single fiber denier of 3 d.

Seven additional kinds of Sample Fibers (II to VIII) were produced in the same way as above, except that treating agents (No. 13 and No. 14) containing different silicone resins and treating agents No. 3, No. 4 and No. 10 to No. 12 of Examples 1 and 2 were used.

The slipperiness and spinnability of these fibers were evaluated and the results are shown in Table 3.

TABLE 3

| Fiber No. | Treating agent No. | Bath stability | Slipperiness after boiling | Spinnability |
|---|---|---|---|---|
| I | 1 | O | O | O |
| II | 13 (Note) | O | Δ | O |
| III | 14 (Note) | O | X | O |
| IV | 3 | O | X | X |
| V | 4 | O | O | X |
| VI | 10 | O | O | X (Winding-around) |
| VII | 11 | Δ | O | X (Static electricity) |
| VIII | 12 | O | O | X (Winding-around) |

Note:

| Treating agent No. | Silicone resin: Functional group | Silicone resin: Viscosity at 25° C. (cs) | Silicone resin: Amine content (m mol/g) |
|---|---|---|---|
| 13 | $-(CH_2)_3-NH_2$ | 1000 | 0.2 |
| 14 | $-(CH_2)_3-NH-CH_3$ | 1500 | 0.5 |

From the above Table, it is clearly understood that as for Fiber (I) according to the present invention, the bath stability of the treating agent was good and the slipperiness and spinnability of the fiber after treatment were good, whereas for Fiber (II) and Fiber (III) in which the silicone resins do not satisfy the present invention, Fibers (IV and V) in which the antistatic agents do not satisfy the present invention, and Fibers (VI to VIII) in which the mixing ratios in the treating agents are outside the present invention, there was a problem either in the slipperiness or in the spinnability after treatment, even though there was no problem in the bath stability.

EXAMPLE 4

Four kinds of Sample Fibers (IX to XII) were produced in the same way as Fiber (I) of Example 3, except that the silicone resin concentration in the treating agent was changed as described in Table 4.

The results of evaluation are shown in Table 4.

TABLE 4

| Fiber No. | Silicone resin concentration (%) | Slipperiness after boiling | Spinnability |
|---|---|---|---|
| IX | 0.07 | X~Δ | Δ |
| X | 0.35 | O | O |
| XI | 0.85 | O | O |
| XII | 3.0 | O | X (Winding-around) |

From the above Table, it is understood that when the amount of the treating agent taken up was less than the lower limit of the recommended range of the present invention, it is impossible to give the fibers sufficient slippery touch. Also, when the amount exceeds the upper limit of the range, there is a problem in spinnability.

EXAMPLE 5

After the swollen gel fiber tow after stretching (water content: 80%) described in Example 3 was immersed in the treating agent of Example 1 diluted to a silicone resin concentration of 0.4%, the fiber tow was squeezed so that the amount of the treating agent taken up became 80%, based on the weight of the dry fiber. The tow was then treated for 20 minutes in an atmosphere of a dry bulb temperature of 125° C. and a wet bulb temperature of 60° C. Thereafter, the tow was heat-treated for 8 minutes in pressurized water vapor at 130° C. After the tow was then subjected to crimping treatment, it was dried for 5 minutes in a hot air current at 125° C., and was cut in unequal lengths in the range of from 76 to 130 mm, to produce Sample Fiber (XIII) having a single fiber denier of 3 d. This fiber had good slipperiness after boiling and good spinnability.

60% of this fiber and 40% of a highly shrinkable acrylic fiber having 25% latent shrinkability produced in the same way by the turbo-stapler system, were mix-spun in the usual way to produce a no. 36 count two-folded yarn.

The mix-spun yarn thus obtained was hank-dyed, thus developing the latent shrinkability at the same time to give bulkiness to the yarn. Two plies of the spun yarn were arranged in parallel and were supplied to a 7 G weft knitting machine, by which the yarn was knitted to produce a plain stitch knit fabric. The knit fabric was then stretched 4% in the warp direction and then it was subjected to Hoffman set (Knit fabric 1).

For comparison, another plain stich knit fabric (2) was produced in the same way as above except that a non-shrinkable acrylic fiber, to which the treatment recommended in the present invention was not given and only a cationic softening agent Zontes TA 460-15 (produced by Matsumoto Oils and Fats Co. Ltd.) was applied, was used in place of Fiber XIII.

These knit fabrics were evaluated for the ratio of stress lowering on dynamic friction before and after washing and for the touch by sensor tests. The results are shown in Table 5. It is understood that the fabric in which the fiber recommended in the present invention was used in an amount of as much as 60%, retained good slipperiness even after washing.

For the washing, an electric washer for home use was used. The washing was carried out for 10 minutes in warm water at 40° C. containing 1 g/l of New Beads® (a product of Kao Soap Co. Ltd.) at a bath ratio of 1:200. After water-washing for 10 minutes, the fabrics were dehydrated by a centrifuge, and were dried on a flat board in a natural condition.

TABLE 5

| | Original fabric | After washing | |
|---|---|---|---|
| | tan α | tan α | Sensory evaluation |
| Knit fabric 1 | 13.1 | 12.7 | Good slippery touch |
| Knit fabric 2 | 13.4 | >100 | "Creaking" feel |

What we claim is:

1. A softening agent which comprises (A) an organopolysiloxane containing primary and secondary amino groups represented by the formula $-RNHR'NH_2$ wherein each of R and R' is alkylene of 1 to 6 carbon atoms, (B) a partial phosphoric acid ester, having an acid value of from 14 to 60, of alkylphenyl—O—$(C_2H_4O)_lH$ or sec-alkyl—O—$(C_2H_4O)_mH$, wherein l and m are the degree of polymerization and are an integer of from 5 to 20, and (C) a neutralized salt of a complete or partial phosphoric acid ester of alkyl—O—$(C_2H_4O)_nH$, wherein n is the degree of polymerization and is a integer of from 3 to 30, and the degree of phosphorization of said salt is more stably dispersed in an aqueous medium in the ratio of 1 weight part of (A), 0.1 to 0.5 weight part of (B) and 0.1 to 4.0 weight parts of (C).

2. The softening agent as claimed in claim 1 wherein the content of the amino groups in (A) is from 0.1 to 2.0 m mol/g.

3. The softening agent as claimed in claim 1 wherein the content of the amino groups in (A) and the acid value of (B) satisfy the following relation:

$$38N \leqq X \leqq 105N$$

wherein N is the content as m mol/g, of the amino groups in (A), and X is the acid value of (B).

4. The softening agent as claimed in claim 1 wherein the number of carbon atoms of the alkyl group in the alkylphenyl group of (B) is from 8 to 12.

5. The softening agent as claimed in claim 1 wherein the number of carbon atoms of the sec-alkyl group of (B) is from 9 to 17.

6. The softening agent as claimed in claim 1 wherein the number of carbon atoms of the alkyl group of (C) is from 8 to 18.

7. The softening agent as claimed in claim 1 wherein the acid value of (C) is less than 14.

8. A method of producing an acrylic fiber having animal hair-like touch, which comprises applying to an acrylic fiber a softening agent which comprises (A) an organopolysiloxane containing primary and secondary amino groups represented by the formula $-RNHR'NH_2$ wherein each of R and R' is alkylene of 1 to 6 carbon atoms, (B) a partial phosphoric acid ester, having an acid value of from 14 to 60, of alkylphenyl—O—$(C_2H_4O)_lH$ or sec-alkyl—O—$(CH_2H_4O)_mH$, wherein l and m are the degree of polymerization and are an integer of from 5 to 20, and (C) a neutralized salt of a complete or partial phosphoric acid ester of alkyl—O—$(C_2H_4O)_nH$, wherein n is the degree of polymerization and is an integer of from 3 to 30, and the degree of phosphorization of said salt is more than 0.5, stably dispersed in an aqueous medium in the ratio of 1 weight part of (A), 0.1 to 0.5 weight part of (B) and 0.1 to 4.0 weight parts of (C), and heat-treating the acrylic fiber.

9. The method as claimed in claim 8 wherein the organopolysiloxane contains 0.1 to 2.0 m mol/g amino groups.

10. The method as claimed in claim 8 wherein the neutralized salt of phosphoric acid ester has an acid value less than 14.

11. The method as claimed in claim 8 wherein the organopolysiloxane is applied to the acrylic fiber in an amount of 0.05 to 2.0%, based on the dry weight of the acrylic fiber.

12. The method as claimed in claim 8 wherein the heat treatment is carried out at a temperature from 60° to 150° C. in a wet or dry atmosphere.

* * * * *